US006616171B2

(12) United States Patent
Kruajitch

(10) Patent No.: US 6,616,171 B2
(45) Date of Patent: Sep. 9, 2003

(54) DEVICE FOR RAISING AT LEAST ONE BINDING ELEMENT USED ON A BOARD FOR GLIDING

(75) Inventor: André-Jean Kruajitch, La Buisse (FR)

(73) Assignee: Look Fixations SA, Nevers (FR)

( * ) Notice: Subject to any disclaimer, the term of this patent is extended or adjusted under 35 U.S.C. 154(b) by 0 days.

(21) Appl. No.: 09/836,291

(22) Filed: Apr. 18, 2001

(65) Prior Publication Data

US 2001/0042972 A1 Nov. 22, 2001

(30) Foreign Application Priority Data

May 18, 2000 (FR) ..... 00 06335

(51) Int. Cl.[7] ..... A63C 5/00
(52) U.S. Cl. ..... 280/607; 280/623
(58) Field of Search ..... 280/616, 623, 280/634, 633, 602, 607, 617, 618, 625, 636

(56) References Cited

U.S. PATENT DOCUMENTS

| | | | | |
|---|---|---|---|---|
| 3,260,531 A | | 7/1966 | Heuvel | |
| 5,083,809 A | * | 1/1992 | Stampacchia et al. | 280/14.21 |
| 5,513,872 A | * | 5/1996 | Arduin et al. | 280/602 |
| 5,566,966 A | * | 10/1996 | Couderc et al. | 280/602 |
| 5,636,855 A | * | 6/1997 | Couderc et al. | 280/602 |
| 5,647,605 A | * | 7/1997 | Arduin | 280/602 |
| 6,102,425 A | * | 8/2000 | Gotzfried | 280/602 |
| 6,270,108 B1 | * | 8/2001 | Phelipon et al. | 280/602 |
| 6,283,493 B1 | * | 9/2001 | Arduin et al. | 280/602 |
| 2001/0042971 A1 | * | 11/2001 | Krauajitch | 280/611 |

FOREIGN PATENT DOCUMENTS

| | | |
|---|---|---|
| EP | 0 685 244 A1 | 4/1995 |
| FR | 2 684 885 | 12/1991 |
| FR | 2 777 792 | 4/1998 |

OTHER PUBLICATIONS

Abstract of U.S. patent 5,704,628 filed, Jan. 6, 1998.
Abstract of U.S. patent 5,636,855, filed Jun. 10, 1997.
Abstract of U.S. patent 5,647,605, filed Jul. 15, 1997.
Abstract of French. Publication 2777792, published Oct. 29, 1999.

* cited by examiner

*Primary Examiner*—Paul N. Dickson
*Assistant Examiner*—Laura B. Rosenberg
(74) *Attorney, Agent, or Firm*—Browdy and Neimark, P.L.L.C.

(57) ABSTRACT

A device for raising at least one element (5) of a binding used on a board (3) for gliding, including an element (4) which is articulated relative to the board and one end (30) of which comes into contact with the upper face (6) of the board. The element (5) of the binding is mounted on the articulated element (4) and the end (30) of the articulated element (4) is secured to the upper face (6) of the board by attaching member (33) so that the forces exerted vertically at the location of the binding element (5) are partly transmitted to the board (3) at the location of the end (30) of the articulated element (4).

13 Claims, 5 Drawing Sheets

1
2
4
5
8
9
10
11
14
15
28
32
34
35
36
37
39
e
III
III'

2
3
5
6
23
24
29
30

DEVICE FOR RAISING AT LEAST ONE BINDING ELEMENT USED ON A BOARD FOR GLIDING

TECHNICAL FIELD

The invention relates to the field of sports involving gliding over snow. It relates more particularly to the devices used on skis and, in particular, downhill skis. It refers more specifically to devices for raising bindings, making it possible to optimize the transmission of the bearing forces exerted by the skier toward the board.

PRIOR ART

In a known manner, boards for gliding and, in particular, downhill skis include safety bindings consisting of a stop which interacts with the toe of the boot and a heelpiece holding the rear of the boot.

It is well known to mount the binding elements on raising platforms, the aim of which is to elevate the boot above the board for gliding. This is particularly advantageous when the board for gliding has a relatively pronounced sidecut, and it is thus necessary to prevent the boot coming into contact with the snow when the board is inclined laterally.

Other raising platforms have already been proposed to provide a degree of unclamping of the ski. In this type of platform, the rigidity of the sole of the boot and that of the board are dissociated in such a manner that the behavior of the ski corresponds to the intrinsic properties of the board independent of that of the boot.

Other types of raising platform have also been proposed which, on the contrary, act as stiffener in order to increase further the rigidity and stiffness of the board, in particular in the underboot zone. One example of such a platform is, in particular, described in document FR 2 684 885, in which the various elements mounted on the platform interact with one another when a force is exerted vertically by the skier.

A further example of this type of platform is described in document U.S. Pat. No. 5,704,628. Such a platform includes an arm which makes it possible to transmit a portion of the forces exerted longitudinally by the skier as far as an advanced zone located beyond the stop. The arm is connected to a take-up piece secured to the board so that a longitudinal force is exerted on the ski between the stop and the take-up piece in order to give rise to a stiffening. Unfortunately, because of the articulation of the arm for transmitting forces, this type of device does not make it possible to exert vertical forces in front of or behind the elements of the binding.

Another type of platform has also been proposed, such as that described in document FR 2 777 792. Such a platform is composed of a raising plate on which the elements of the binding are arranged. This raising plate rests on flexible strips which extend to the front and to the rear of the zone for mounting the binding, and bear on the upper face of the ski by means of shock-absorbing blocks.

On account of the flexibility of the longitudinal tongues, such a device does not make it possible to transmit sufficiently effective bearing forces, in particular when the skier exerts forces at the location of one of the elements of the binding. Moreover, the presence of elastomeric blocks tends to damp the behavior of the board overall, so such devices are intended more for relatively soft skis and, conversely, very dynamic skis, in particular those used in competition.

A problem which the invention proposes to solve is allowing a raising platform to modify the behavior of the board for gliding when the forces are exerted by the skier, while not increasing its stiffness in terms of flexing and thus allowing it to bend.

SUMMARY OF THE INVENTION

The invention thus relates to a device for raising at least one binding element used on a board for gliding, including an element which is articulated relative to the board, one end of which comes into contact with the upper face of the board.

This device is defined in that the binding element is mounted on the articulated element and in that said end of the articulated element is secured to the upper face of the board by attaching means in such a manner that the forces exerted vertically at the location of the element of the binding are partly transmitted to the board at the location of said end of the articulated element.

In other words, the articulated element serves as a lever and directly receives the vertical bearing forces exerted by the skier. Via its end which is secured to the ski, this lever exerts a portion of these forces in a zone which is offset relative to the binding. These forces may be transferred in front of the stop of the binding or behind the heelpiece. Complementarily, the raising device according to the invention does not interfere with the behavior of the board when the latter bends, since the articulation of the articulated element allows the platform as a whole to deform when the board flexes.

Advantageously, in practice, the articulated element on which the element of the binding is mounted may be articulated either directly on the structure of the board or, alternatively, relative to a fixed element secured to the upper face of the board.

In this latter case, provision may be made for the fixed element to receive also the binding element which is not mounted on the articulated element, in such a manner that the entire binding is mounted on the same raising device.

Various modes of behavior may be obtained depending on the position of the point of articulation relative to the element of the binding.

Thus, in a first embodiment, the articulated element may be articulated relative to the board at the location of its end opposite the end secured to the upper face of the board, in such a manner that the forces exerted at the location of the element of the binding give rise, on the upper face of the board, to a force in the same direction.

In other words, the element of the binding is then between the articulation relative to the board and the end of the articulated element which rests on the board.

In this way, when the skier initiates a turn and exerts forces at the location of the front stop of the binding, a portion of these forces is exerted via the device according to the invention a few centimeters or even a few tens of centimeters in front of the stop. Under these conditions, the bearing forces are exerted in a longer zone of the underboot section, which allows efficient turn initiation and better control through the turn. This type of behavior is particularly sought-after in competitions of the giant-slalom type, in which turn initiation is particularly important.

Conversely, in a second embodiment, the articulated element may be articulated relative to the board at a location located between the site of the element of the binding and the end secured to the upper face of the board, in such a manner that the forces exerted at the location of the element of the binding give rise, on the upper face of the board, to a force in the opposite direction. In other words, the articulation of the articulated element is between the element of the binding and the point of attachment of the articulated element on the ski.

In this way, when the skier initiates a turn and exerts forces at the location of the stop of the binding, a portion of these forces is exerted via the device according to the invention in front of the stop, and they tend very slightly to raise the board in its front part or at the very least to shorten the zone of application of the pressure exerted by the ski on the snow. In this way, the bearing forces exerted by the skier tend slightly to bend the ski which then behaves as a board of shorter length.

It is thus easier and quicker to then link in the following turn.

It will be appreciated, therefore, that this type of behavior is particularly sought-after within the context of "special" slaloms, in which linking of the turns is particularly important.

Advantageously, in practice, the articulated element may include a transverse groove located on its upper face and sited between the site of the element of the binding and the end secured to the upper face of the board, said groove being filled with an elastic material so as to allow the flexing of said articulated element when the board flexes and its rapid return into position when the cause of the flexing has disappeared.

In other words, this groove allows a supplementary deformation of the raising device which is added to the articulation capability.

Moreover, the presence of an elastic material makes the raising device and thus the entire board more dynamic by opposing excess flexing of the articulated element. By using elastic materials which also possess shock-absorbing properties, such as viscoelastic materials, it is also possible to absorb a portion of the energy which has given rise to the deformation of the articulated element, by virtue of the shearing of the viscoelastic material. In this case, it is, in particular, possible to absorb a certain portion of the vibrations propagating along the board.

Advantageously, in practice, the means for attaching the end of the articulated element onto the upper face of the board allow a longitudinal displacement of said articulated element when the ski is significantly bent.

In other words, when the board is significantly bent, the end of the bearing zone may slide slightly relative to the upper face of the board in order to prevent longitudinal forces being exerted on the board. Indeed, the attaching means have the essential function of transferring a portion of the vertical forces exerted by the skier and must not secure the raising device via two ends, at the risk of generating clamping of the board.

Advantageously, in practice, this ability of the end of the articulated element to be displaced longitudinally may be obtained by interposing a layer of viscoelastic material between the upper face of the board and the end of the articulated element.

In this case, the layer of viscoelastic material efficiently transmits forces which are exerted vertically, and works in shear when the articulated element tends to be displaced longitudinally.

In practice, the lower face of the articulated element is shaped so as to clear an empty space between the articulated element and the upper face of the board, between the end secured to the board and the point of articulation of the articulated element.

In other words, only the end of the articulated element comes into contact with the board in order not to risk clamping the board and to push back as far as possible from the binding the zone in which the forces are transferred.

In a more improved embodiment, the device according to the invention may also include a second element which is articulated relative to the board, on which is mounted the other element of the binding and one end of which is secured to the upper face of the board by attaching means.

In this way, similar modes of behavior are obtained when forces are exerted at a location in front of or behind the binding.

In this case, advantageously, in practice, the two articulated elements may be articulated relative to the board about a common articulation pin.

As already stated, this articulation may be achieved either directly on the board or on a fixed element secured to the board.

In a particular embodiment, the two articulated elements may be mechanically secured to one another so as to form a rocker.

In this case, when the forces are exerted, for example, at the location of the front of the binding, the front of the board [lacuna] equally forces exerted downward, extending the zone over which the bearing forces are exerted, while the rear zone is eased and slightly bent.

Advantageously, in practice, the articulated element may include, on its lower face, in line with the site of the binding element, elastic return means.

These means may consist of a compressible foam which has the supplementary advantage of filling in a portion of the volume located under the articulated element in order to prevent the formation of accumulations of snow. These means may also be viscoelastic in order to afford the skier greater comfort.

In a particular embodiment, the articulated element may include two arms extending in the longitudinal direction of the board, these arms being connected at the location of the means for attaching to the board.

In this way, the transmission of forces in the vicinity of the lateral zones of the board, substantially in line with the edges, is promoted.

BRIEF DESCRIPTION OF THE FIGURES

The way in which the invention is embodied and the advantages arising therefrom will become clearly apparent from the description of the following embodiments, supported by the appended figures, in which.

EMBODIMENT OF THE INVENTION

As already stated, the invention relates to a raising device designed to receive at least one of the elements of a safety binding. In the remainder of the description, all the devices illustrated receive the front stop of the binding and, if appropriate, the rear heelpiece. Obviously, the invention is not limited to these embodiments alone, but also covers variants in which the heelpiece alone is mounted on the raising device.

Figure 1:
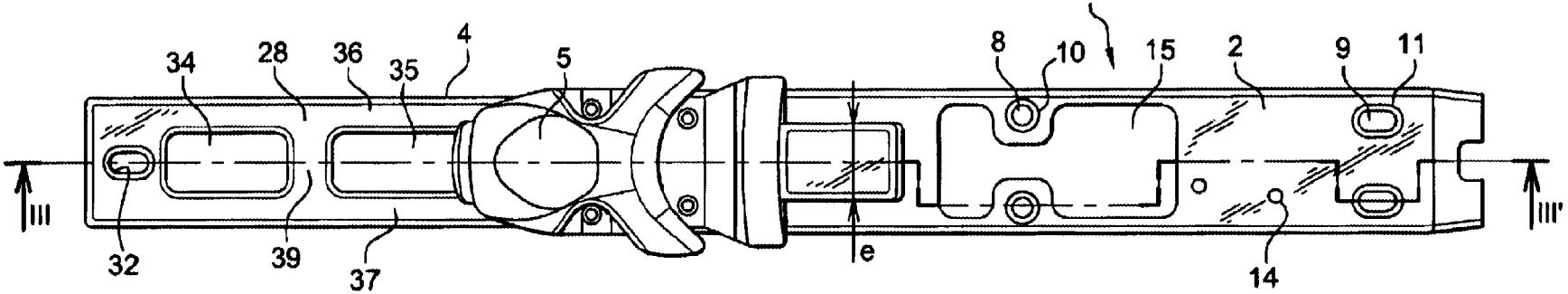
FIG. 1 is a top view of a raising device according to the invention, produced according to a first variant embodiment.
Figure 2:
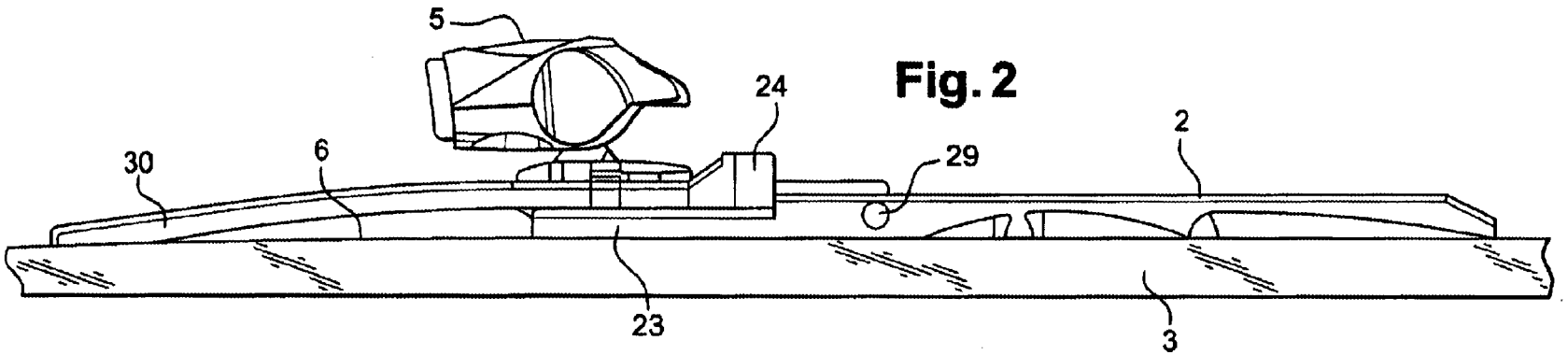
FIG. 2 is a side view of the platform of FIG. 1.
Figure 3:
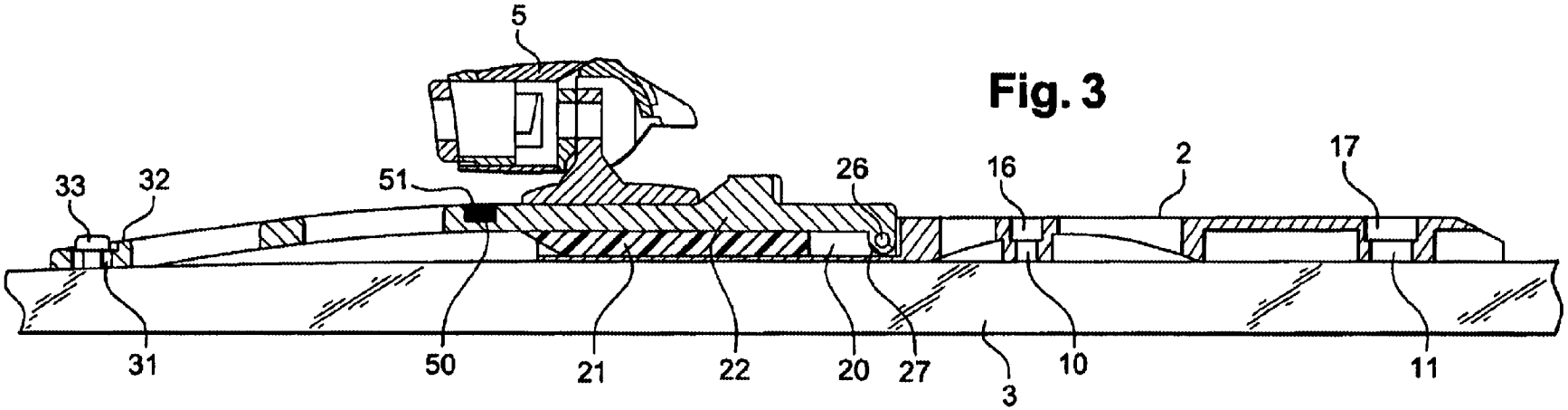
FIG. 3 is a sectional view along the arrows III–III' of FIG. 1.

In the variant illustrated in FIGS. 1 to 3, the raising device (1) is composed of a fixed element (2) (or platform) secured to the board (3) at the location of the underboot zone, and an articulated element (4) which receives the stop (5) of the binding. This articulated element (4) bears on the upper face (6) of the board (3).

More precisely, the fixed element (2) illustrated in FIG. 1 is secured to the upper face (6) of the board (3) by a plurality of screws (8, 9) housed in openings (10, 11) provided for this purpose, substantially at the median location and to the rear of the fixed element (2). The openings (10) located at the median location have a diameter which is substantially equal to that of the screws (8), while the rear openings (11) are elongate in the longitudinal direction in order to allow a slight sliding of the rear of the platform (2) when the board bends considerably in the underboot region.

This prevents excess clamping of the board by the fixed element (2). The different apertures (10, 11) receiving the screws for securing to the board have a shoulder (16, 17) which allows efficient and firm application of the platform (2) on the board.

As illustrated in FIG. 1, the fixed element (2) has, at its median location, a recess (15) designed to lighten this element and to make it more supple when it flexes.

In the rear part of the fixed element (2), threaded holes (14) are provided to allow the positioning of the heelpiece of the binding.

At the location of its front zone, the fixed element (2) includes a housing (20) designed to receive the rear part (22) of the articulated element (4). The housing (20) includes lateral walls (23) opposite the sides of the rear part of the articulated element (4), making it possible to avoid any introduction of snow which could disrupt the operation of the device.

As illustrated in FIG. 3, the housing (20) may receive a small plate (21) on the lower face of the articulated element (4) made from viscoelastic material which is intended to damp certain vertical movements of the articulated element (4).

As may be seen in FIGS. 2 and 3, the articulated element (4) receives the front stop (5) of the binding on its upper face. This stop (5) is secured by screwing or by any other appropriate means. To the rear of the site of the stop (5), the articulated element (4) may receive an optional device (24) which makes it possible to facilitate pivoting of the boot in the lateral direction.

The rear part (22) of the articulated element (4) has a length l; which is shorter than that of the fixed element (2), which is approximately half the latter. The rear end of the rear part (22) of the articulated element (4) includes a transverse housing (26) opening out on either side, which is traversed by an articulation pin (27) whose ends (29) are accommodated in openings provided in the fixed element (2). At least one of these openings opens out laterally from the fixed element (2) in order to allow positioning of the articulation pin (27).

The front part (28) of the articulated element (4) extends over approximately twenty centimeters beyond the median location of the stop (5) of the binding. This articulated element (4) comes into contact with the upper face (6) of the board only at the location of its end (30). As may be seen in FIG. 3, this end (30) includes a through-opening (31) intended for receiving the means for attaching to the board. This opening is slightly elongate in the longitudinal direction in order to allow relative sliding of the articulated element (4) relative to the upper face (6) of the board. This opening also has a shoulder interacting with the corresponding shoulder (32) of the fastening screw (33). In this way, the front end (30) of the articulated element (4) is permanently in contact with the upper face (6) of the board and cannot be detached therefrom.

In the embodiment illustrated in FIG. 1, the front part (28) of the articulated element (4) includes two recesses (34, 35) which make it possible to define two lateral arms (36, 37) which join up at the central location (39) and at the location of the zone (30) for attaching to the upper face (6) of the board. In this way, the bearing forces exerted at the location of the stop (5) are preferentially transmitted to the lateral sides of the board, in line with the edges.

Figure 8:
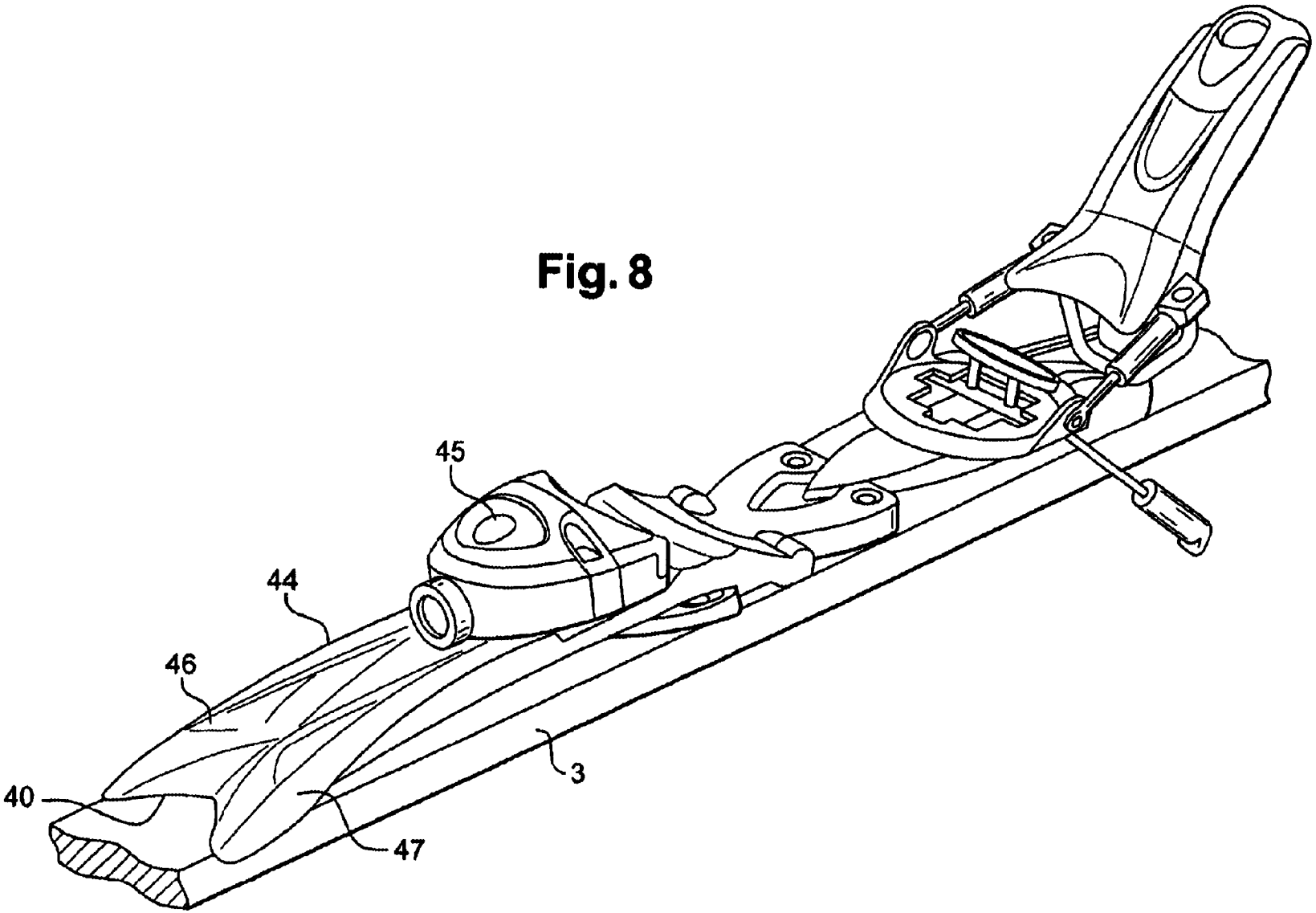
FIG. 8 is a summary perspective view of three quarters of a further variant embodiment.

In the variant illustrated in FIG. 8, the articulated element (44) may have a particular shape, in which two arms (46, 47) are distinguished, extending from a point in line with the element (45) of the binding as far as the vicinity of the zone (40) for attaching to the board.

Returning to FIG. 3, in a particular embodiment the articulated element may also include a transverse groove (50) extending from one side to the other of the articulated element (4). This transverse groove (50) is designed to confer a certain ability to flex on the articulated element (4), which is particularly advantageous, in order to limit the clamping of the board when the latter is significantly bent. In this case, the articulated element (4) deforms slightly at the location of the transverse groove (50) without generating forces at the location of the front end (30) of the articulated element (4).

Advantageously, this groove (50) may be filled with an elastic or viscoelastic material (51) such as natural rubber, synthetic rubber, thermoplastic materials or the like, which accelerates the return into a position of rest of the articulated element.

During operation, when the skier exerts vertical forces at the location of the stop (5) of the binding, in particular in the initial stages of a turn, the front part (28) of the articulated element (4) transmits a portion of these forces as far as the location of the attaching zone (30). The vertical forces are thus exerted markedly in front of the stop (5) of the binding. Thus, by virtue of the invention, the zone over which the vertical forces are exerted extends in a more elongate manner than in devices of the prior art.

Figure 4:
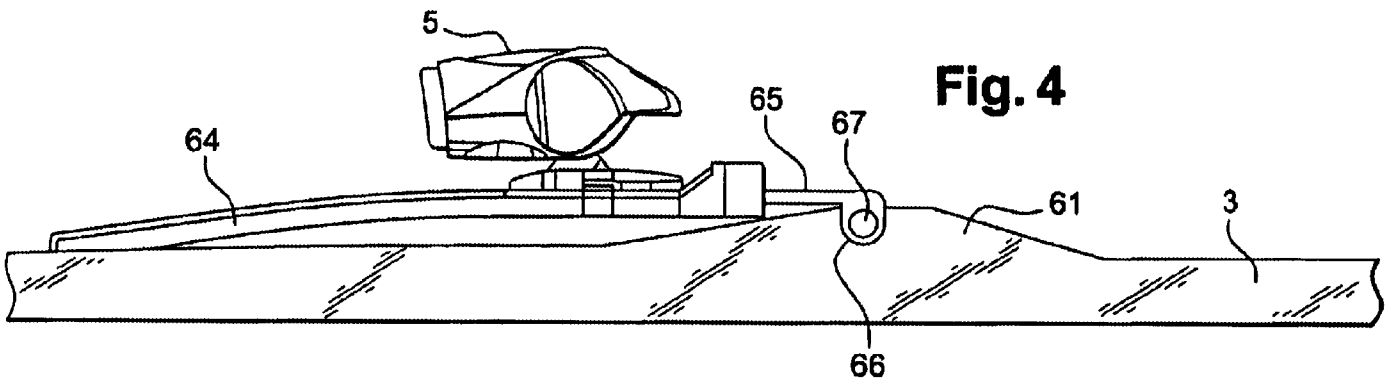
FIG. 4 is a side view of a platform according to the invention, articulated directly on the ski.

In the variant illustrated in FIG. 4, the articulated element is articulated directly on the board for gliding. The board for gliding thus includes a protuberance (61) at the location of the underboot zone. The rear (65) of the articulated element (64) covers over this protuberance (61) at the sides. The lateral tabs (66) of the articulated element (64) are drilled in order to receive the articulation pin (67) which traverses the protuberance (61) of the upper face of the board. Operation of the raising device is identical to that of the embodiment illustrated in FIGS. 1 to 3.

Figure 5:
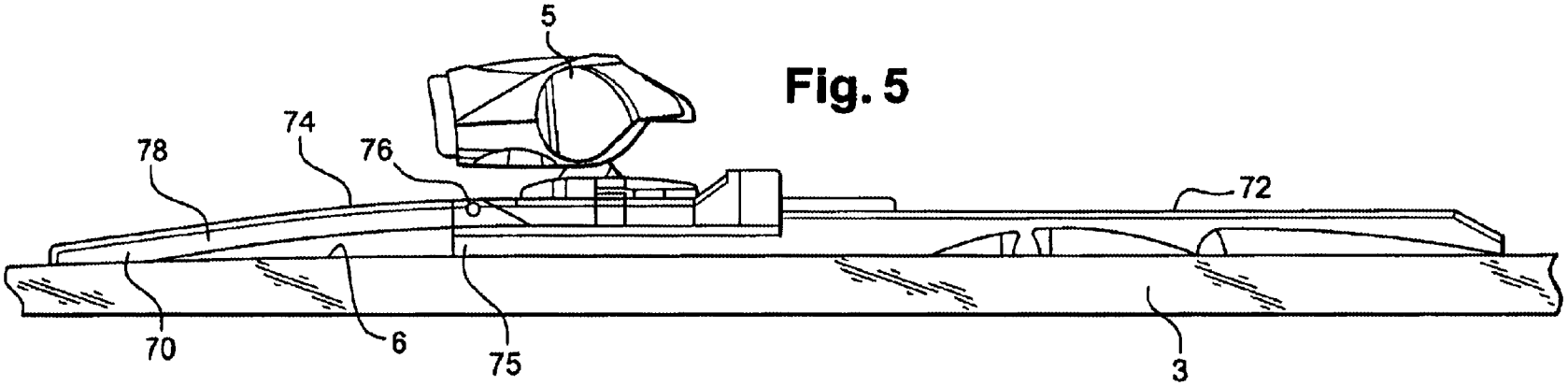
FIGS. 5, 6 and 7 are side views of three variant embodiments of devices according to the invention.

FIG. 5 illustrates a further variant embodiment in which the fixed element (72) extends forward, beyond a point in line with the stop (5) of the binding. The articulated element (74) has a zone (75) of articulation relative to the fixed element, which is located in front of the stop (5) of the binding. Various means of articulation may be employed, and in particular that illustrated in FIG. 5. In this case, the articulated element (74) and the fixed element (72) include opposite zones traversed completely by an articulation pin (76). In the same way as for the embodiments illustrated in FIGS. 1 to 3, the front end (70) of the articulated element (74) is secured to the upper face (6) of the board.

During operation, the device of FIG. 5 differs from that of the preceding Figures. Indeed, when a force is exerted vertically by the skier at the location of the stop (5) of the binding, the articulated element (74) pivots about the articulation pin (76) which is located in front of the stop (5). The result of this is that the front part (78) of the articulated element (74) tends to rise. By virtue of the securing of the articulated element (74) on the upper face (6) of the board, the latter is subjected to an upward force which tends to bend it. The result of this is thus that the distribution of pressure over the snow is concentrated at the location of the stop of the binding, which facilitates pivoting movements and is thus particularly sought-after for special-slalom skiing.

Figure 6:
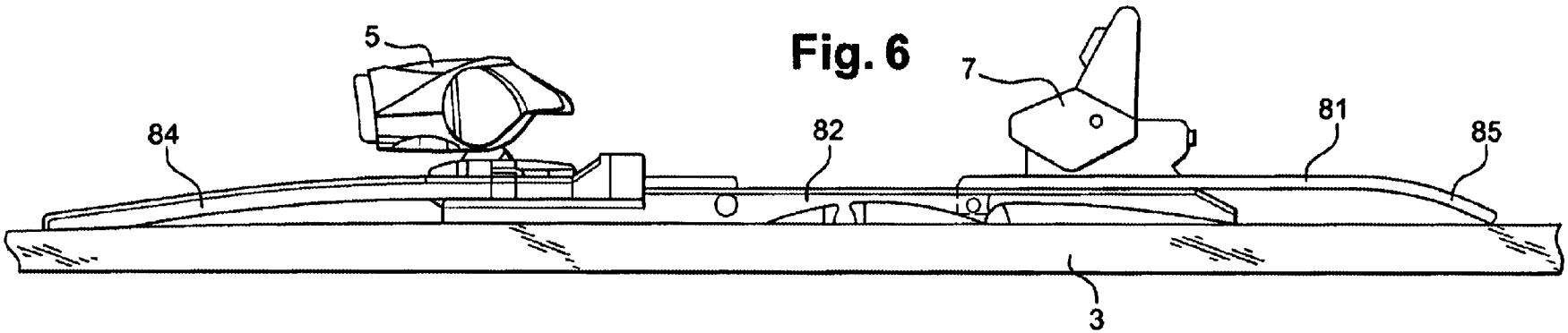

FIG. 6 illustrates a variant embodiment in which the raising device includes an articulated element (84) supporting the stop (5) of the front of the binding, and a second, rear articulated element (81) supporting the heelpiece (7) of the binding. The structure of the rear articulated element (81) is similar to that of the front articulated element (84), and the way in which it operates is similar. Thus, when forces are exerted vertically at the location of the heelpiece (7) of the binding, the rear articulated element (81) transfers a portion of these forces further back than the heelpiece (7). The behavior of the rear of the ski thus corresponds to that of a longer ski, which allows better running through the curve in the turning phase.

As already stated, the two articulated elements may optionally share a common articulation pin.

Figure 7:
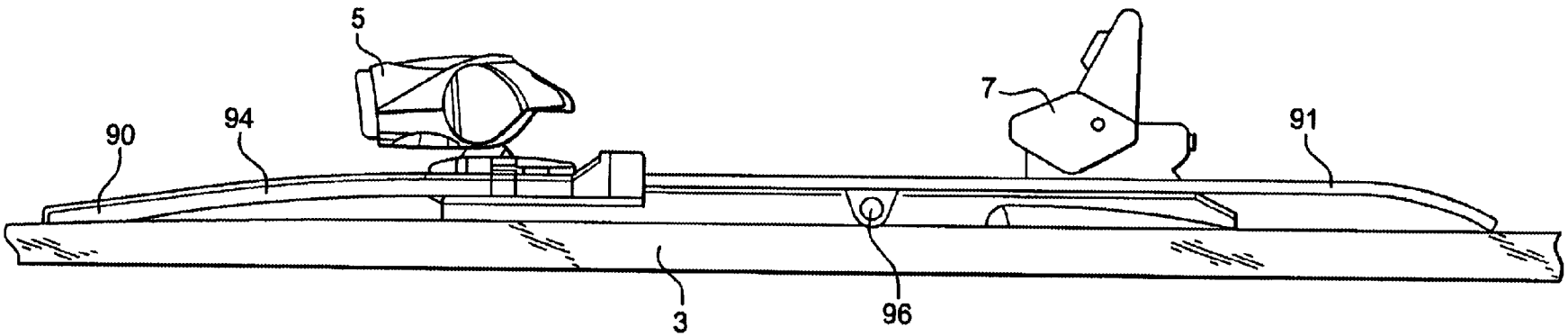

In the variant illustrated in FIG. 7, the two articulated elements, namely the front articulated element (94) and the rear articulated element (91), have a common articulation pin (96) and are, moreover, mechanically connected in order to be secure and form a rocker. Thus, during operation, when the forces are exerted vertically at the location of the front stop (5), a portion of these forces is exerted in the same direction at the location of the front end (90) of the front articulated element (94), while the rear articulated element (91) tends to rise. The rear part of the ski thus has a slight tendency to bend, and at the very least to have the pressure distribution offset forward. This behavior is particularly useful in the turn-initiation phase.

Conversely, when the forces are exerted at the location of the heelpiece (7) of the binding, the pressure distribution is significantly lightened at the front and concentrated in the rear of the board.

It emerges from the aforesaid that the raising device according to the invention has a number of advantages, in particular:

transfer of a portion of the forces exerted at the location of the elements of the binding;

better turn initiation or an increase in the ability to pivot, depending on the position of the articulation pin of the articulated element relative to the corresponding binding element;

the ability of the raising device to flex, limiting clamping when the board is significantly bent.

What is claimed is:

1. A device (1) for raising at least a first binding element (5) used on a board (3) for gliding, comprising:

a first articulated element (4) which is articulated relative to the board a first end (30) of the first articulated element being engaged to an u per face (6) of the board;

wherein the first binding element (5) is mounted on the first articulated element (4) and wherein said first end (30) of the first articulated element (4) is secure to the upper face (6) of the board in front of the first binding element by attaching means (33) so that forces exerted vertically on a mounting of the first binding element (5) are partly transmitted to the board (3) at a point where the first end (30) of the first articulated element (4) is secured in front of the first binding element.

2. The device as claimed in claim 1, wherein the first articulated element (74) is articulated relative to the board at a location (75) located between site of the first binding element (5) and a first end (70) secured to the upper face (6) of the board, so hat forces exerted at a location of the binding element give rise to a force in first an opposite direction on the upper face of the board.

3. The device as claimed in claim 1, wherein the first articulated element (64) is articulated directly on the board.

4. The device as claimed in claim 1, wherein the first articulated element (4) is articulated relative o the board at a second end (22) of the first articulated element (4) behind the first binding element opposite from the first end (30) secured to the upper face (6) of the board, so that the forces exerted at the location of the first binding element gives rise to a force in a same direction on the upper face of the board.

5. The device as claimed in claim 1, wherein the first articulated element (4) is articulated relative to a fixed element (2) secured to the upper face (6) of the board.

6. The device as claimed in claim 5, wherein the fixed element (2) receives a second binding element (7) which is not mounted on the first articulated element (4).

7. The device as claimed in claim 5, having a second articulated element (81), articulated relative to the fixed element (82), on which is mounted a second binding element (7), one end (85) of the second articulated member being secured to the upper face (6) of the board by attaching means.

8. The device as claimed in claim 7, wherein the first and the second articulated elements are articulated relative o the board about a common articulation pin.

9. The device as claimed in claim 8, wherein the first and the second articulated elements (94, 91) are mechanically secured to one another so as to form a rocker.

10. The device as claimed in claim 1, wherein the first articulated element (4) includes a transverse groove (50) located on an upper face thereof between a mounting for the first binding element (5) and the first end (30) of the first articulated element secured to the upper face (6) of the board, said groove (50) being filled with an elastic material (51) so as t allow flexing of said first articulated element (4) when the board flexes and rapid return into position.

11. The device as claimed in claim 1, wherein the attaching means (31–33) for attaching the first end (30) of the first articulated element (4) onto the upper face (6) of the board allow a longitudinal displacement of said first articulate element (4) when the board is significantly bent.

12. The device as claimed in claim 1, wherein a lower face of the first articulated element is shaped so as to clear an empty space between the first articulated element (4) and the upper face (6) of the board, between the first end (30) secured to the board and a point (27) of articulation of the first articulated element.

13. The device as claimed in claim 1, wherein the first articulated element has elastic return means (21) on a lower face of the first articulated element, in line with a mounting for the first binding element.

* * * * *